US009401133B2

(12) United States Patent
McGinly

(10) Patent No.: US 9,401,133 B2
(45) Date of Patent: Jul. 26, 2016

(54) ADJUSTABLE, FLOOR-MOUNTED ELECTRIC GUITAR EFFECT PERFORMANCE AND STORAGE APPARATUS

(71) Applicant: William Thomas McGinly, Philadelphia, PA (US)

(72) Inventor: William Thomas McGinly, Philadelphia, PA (US)

( * ) Notice: Subject to any disclaimer, the term of this patent is extended or adjusted under 35 U.S.C. 154(b) by 0 days.

(21) Appl. No.: 14/861,290

(22) Filed: Sep. 22, 2015

(65) Prior Publication Data

US 2016/0086591 A1 Mar. 24, 2016

Related U.S. Application Data

(60) Provisional application No. 62/053,460, filed on Sep. 22, 2014.

(51) Int. Cl.

| | |
|---|---|
| ***G10D 9/00*** | (2006.01) |
| ***G10H 1/34*** | (2006.01) |
| ***G10G 5/00*** | (2006.01) |
| ***G10H 1/32*** | (2006.01) |

(52) U.S. Cl.

CPC ..... *G10H 1/348* (2013.01); *G10G 5/00* (2013.01); *G10H 1/32* (2013.01); *G10H 2210/155* (2013.01)

(58) Field of Classification Search

CPC ..... G10H 1/32; G10H 1/348

See application file for complete search history.

(56) References Cited

U.S. PATENT DOCUMENTS 4,445,415 A * 5/1984 Izquierdo ..... G10H 1/32 206/314
4,488,468 A * 12/1984 Peterson ..... G10H 1/34 200/86.5
5,166,467 A * 11/1992 Brown ..... G10H 1/348 84/715
5,475,214 A * 12/1995 DeFranco et al. ..... A63F 13/06 250/221
D395,969 S * 7/1998 Barlow-Lawson ..... D6/707.15
5,866,829 A * 2/1999 Pecoraro ..... G10H 1/32 84/177
6,215,055 B1 * 4/2001 Saravis ..... G10H 1/348 84/422.1
6,459,023 B1 * 10/2002 Chandler ..... G10H 1/32 84/177
6,538,185 B1 * 3/2003 Stratton ..... G10H 1/348 84/422.1
6,723,909 B1 * 4/2004 Hooper, II ..... G10G 5/00 84/177
6,743,971 B1 * 6/2004 Chen ..... G10H 1/32 84/746
D520,553 S * 5/2006 Bogdan ..... D13/167
7,485,792 B2 * 2/2009 Collins, Sr. ..... G10H 1/32 84/422.1
8,614,385 B2 * 12/2013 McKinney et al. .... G10H 1/348 84/453
8,642,870 B1 * 2/2014 Rosa ..... A47G 27/0212 84/453
8,957,297 B2 * 2/2015 Urry ..... G10H 1/06 84/721
D745,923 S * 12/2015 Trifilio ..... D17/20
2004/0250673 A1 * 12/2004 Salerno ..... G10H 1/32 84/746
2015/0325224 A1 * 11/2015 Manosa Ripoll ..... G10H 1/32 84/444

* cited by examiner

*Primary Examiner* — Robert W Horn

(74) *Attorney, Agent, or Firm* — Pepper Hamilton LLP

(57) ABSTRACT

Embodiments are directed to an adjustable, floor-mounted electric guitar effect performance and storage apparatus for providing easier access to effect pedals and/or floorboards used by guitarists on stage during practices and/or performances. The apparatus includes two platforms, a lower and an upper, each of which is capable of holding various configurations of electric guitar effect pedals and/or floorboards. The upper platform is extendible and retractable by pushing or pulling with one's foot to gain access to pedals on the lower platform. Extension and retraction (gliding back and forth) is made possible by the use of standard drawer slides, installed in reverse, allowing the upper platform to move away and reveal the lower platform. In addition, the height of the upper platform can be adjusted for performance or storage.

14 Claims, 4 Drawing Sheets

ADJUSTABLE, FLOOR-MOUNTED ELECTRIC GUITAR EFFECT PERFORMANCE AND STORAGE APPARATUS

CROSS-REFERENCE TO RELATED APPLICATIONS

This application claims priority to U.S. Provisional Patent Application No. 62/053,460, filed on Sep. 22, 2014 and entitled "The Vertiglide Space Station Pedal Rack," the contents of which are herein incorporated by reference in their entirety.

BACKGROUND

A guitarist in performances may use various foot-controlled sound effect devices (called "pedals," "processors," or, in a larger form, "floorboards") to change the sound of the guitar. These sound changes may include volume, distortion, echo, repeating or looping tones, and making the guitar sound like other instruments (e.g., a piano, a saxophone, etc.). Each sound generated by an effect pedal is controlled by one or more switches, or, in the case of multi-effect floorboards, by switches that retrieve designated sounds identified by separate program numbers that are changed while performing a song. Effect pedals, including larger floorboards that combine the various capabilities of multiple effect pedals into one larger unit, are typically arrayed on the floor in front of the guitarist to be controlled by his/her foot. They are connected to each other, and to a source of amplification, using many cords.

Individual effect pedals and/or floorboards are space-consuming, cluttered, and difficult to reach to make required mid-performance adjustments. Often the effect pedals and/or floorboards are arranged in an "L" or "U" formation, forcing the guitarist to pivot his/her body to face and reach each effect pedal and/or floorboard in order to constantly or frequently change program numbers mid-song. This is awkward and distracting, and may cause the guitarist to be positioned away from his/her microphone.

Thus, there is a need for an apparatus that provides easier access to effect pedals and/or floorboards on stage during performances. It is also desired to save space on stage, as well as to provide a streamlined packing and storage solution for the effect pedals and/or floorboards.

SUMMARY

Embodiments disclosed herein are directed to an adjustable, floor-mounted electric guitar effect performance and storage apparatus.

In an embodiment, an adjustable, floor-mounted electric guitar effect performance and storage apparatus includes: a stationary lower platform; a movable upper platform; a plurality of drawer slides, each attached to a respective side edge of the movable upper platform and to upper ends of respective one or more longitudinally-extending adjustable posts; lower ends of the adjustable posts are attached to the stationary lower platform; the plurality of drawer slides are configured to extend the movable upper platform to an open position in which at least a portion of a top surface of the stationary lower platform is exposed, and retract the movable upper platform to a closed position in which the top surface of the stationary lower platform is substantially concealed by the movable upper platform; the stationary lower platform and the movable upper platform are substantially planar, are substantially parallel with respect to one another when the movable upper platform is in the closed position, and are substantially parallel to a surface on which the apparatus rests; and each of the stationary lower platform and the movable upper platform are configured to hold one or more effect pedals and floorboards.

In an embodiment, the stationary lower platform is supported by a first frame and the movable upper platform is supported by a second frame. In this embodiment, the plurality of drawer slides are each attached to a respective side portion of the second frame and to the upper ends of the respective one or more longitudinally-extending adjustable posts; and the lower ends of the adjustable posts are attached to the first frame.

In an embodiment, the apparatus includes an upper platform foot ledge attached to a front edge of the movable upper platform.

In another embodiment, the apparatus includes one or more riser supports positioned at a back portion of the stationary lower platform configured to angle the one or more effect pedals and floorboards contained on the stationary lower platform. In an additional embodiment, the pedal rack may also include a lower platform pedal brace attached at a front portion of the stationary lower platform configured to prevent the one or more effect pedals and floorboards contained on the stationary lower platform from sliding off of the stationary lower platform.

According to an embodiment, the adjustable posts comprise four adjustable posts, each positioned substantially at a corner of the stationary lower platform and the movable upper platform to longitudinally extend between the stationary lower platform and the movable upper platform when the movable upper platform is in the closed position.

In an embodiment, the adjustable posts are each comprised of an outer shaft and an inner shaft with holes that align with one another, the inner shaft of a smaller size than the outer shaft to allow movement of the inner shaft within the outer shaft. In each of the adjustable posts, insertion of a hitch pin in the holes secures the inner and outer shafts to one another.

In yet another embodiment, the posts are not adjustable.

BRIEF DESCRIPTION OF THE DRAWINGS

The foregoing and other aspects of the invention are best understood from the following detailed description when read in connection with the accompanying drawings. The drawings depict embodiments solely for the purpose of illustration; it should be understood, however, that the disclosure is not limited to the specific instrumentalities disclosed. Included in the drawings are the following Figures.

DETAILED DESCRIPTION

Embodiments are directed to an adjustable, floor-mounted electric guitar effect performance and storage apparatus (hereinafter "pedal rack") for providing easier access to effect pedals and/or floorboards used by guitarists on stage during practices and/or performances. The pedal rack, according to embodiments disclosed herein, also conveniently saves space on stage and provides a streamlined packing and storage solution for the effect pedals and/or floorboards. The pedal rack disclosed herein may be referred to as "The Vertiglide Space Station Pedal Rack."

Figure 1:
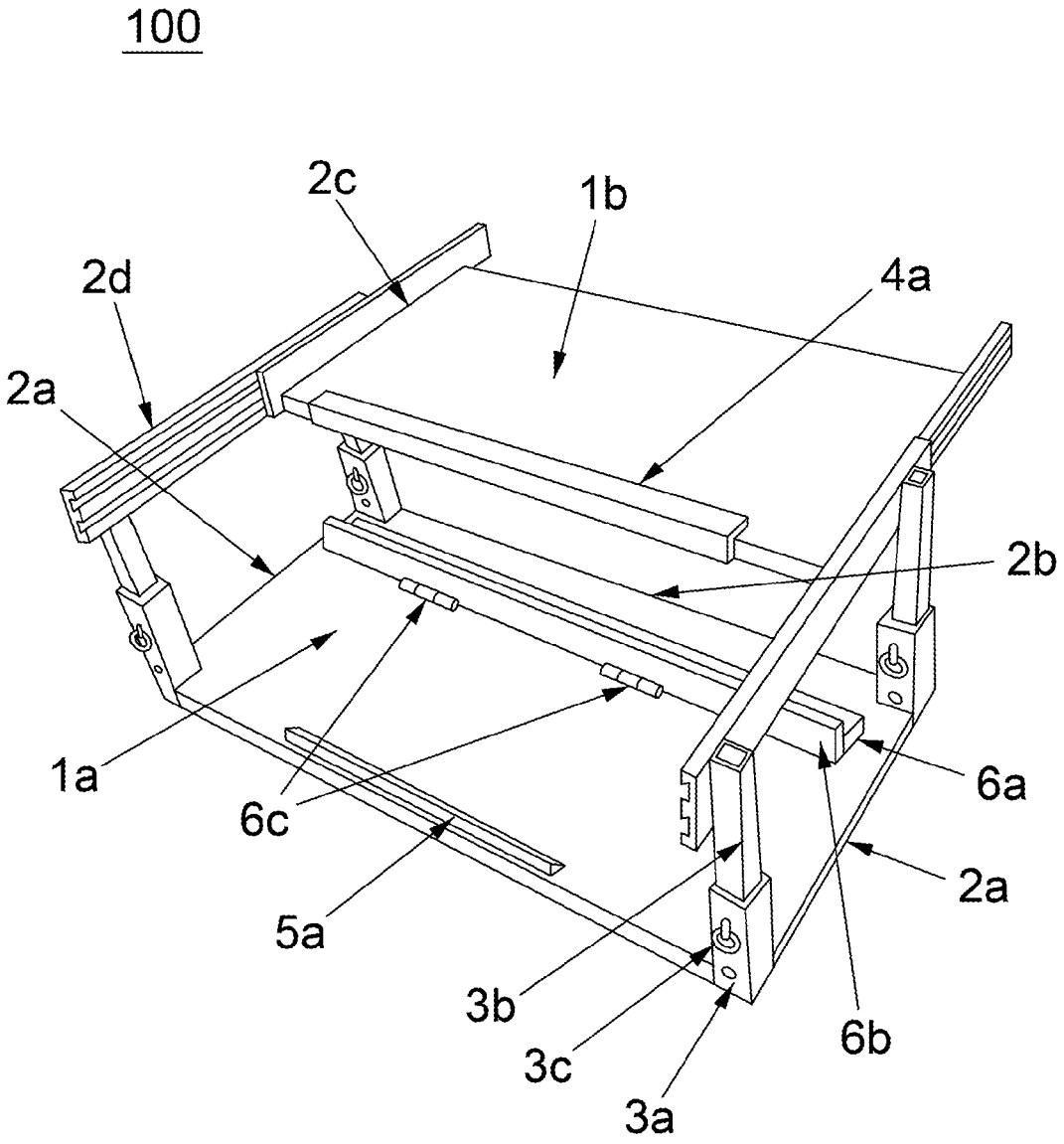
FIG. 1 is a perspective view of a pedal rack, shown in an open position, according to an embodiment.
Figure 2:
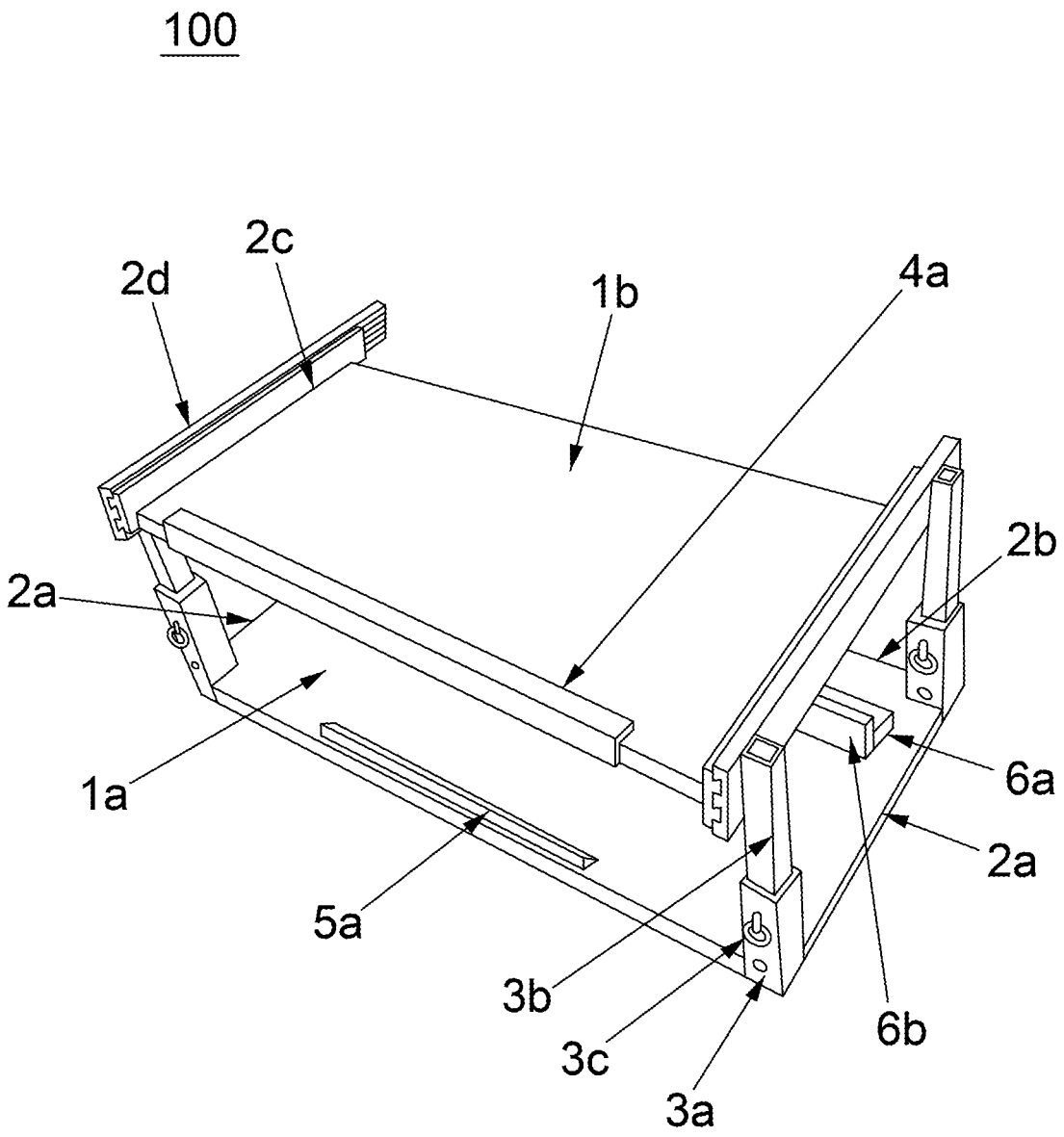
FIG. 2 is a perspective view of the pedal rack illustrated in FIG. 1, shown in a closed position, according to an embodiment.

With reference to FIGS. 1 and 2, a pedal rack 100 is provided. FIG. 1 provides a perspective view of the pedal rack 100, shown in an open position, and FIG. 2 provides a perspective view of the pedal rack 100 in a closed position. The pedal rack 100 includes a stationary lower platform 1*a* and a movable upper platform 1*b*. The platforms 1*a* and 1*b* are substantially planar and are substantially parallel with respect to one another when the movable upper platform 1*b* is in a closed position (see FIG. 2), and are substantially parallel to a surface on which the pedal rack 100 rests. The platforms 1*a* and 1*b* are configured to hold one or more effect pedals and/or floorboards for use by a guitarist.

In an embodiment, the lower platform 1*a* and the upper platform 1*b* are comprised of wood, such as plywood, although other materials may be utilized, such as, for example, composite wood, other composite materials, plastic, metal, or any other material suitable to be used in the configuration and operation described herein. In an embodiment, the dimensions of the platforms are 1' deep×2' long×⅝" thick. Other dimensions may be used, and the dimensions of the lower platform 1*a* and the upper platform 1*b* may vary slightly (e.g., the platforms may vary by +/−1-10% from each other).

In an embodiment, the stationary lower platform 1*a* is supported by a first frame, and the movable upper platform 1*b* is supported by a second frame. In an embodiment, the first frame is comprised of two side supports 2*a* and a horizontal rear support 2*b*. In an alternative embodiment, the first frame is comprised of two side supports 2*a*. In an embodiment, the second frame is comprised of two side supports 2*c*. The second frame may also include a horizontal rear support. Horizontal front supports may also be incorporated for both or either frames. The frames may be made of, for example, aluminum and may be secured to the respective platforms using nuts and bolts. In one embodiment, 1/16" thick aluminum is used for the frame components. Other materials, sizes, and fastening means may also be used, such as, for example, plastic and glue.

With continued reference to the pedal rack 100 shown in FIGS. 1 and 2, a plurality of drawer slides 2*d* are provided. The drawer slides 2*d* may be any commercially available drawer slide and may be, for example, soft close, ball bearing drawer slides. In an embodiment, the drawer slides 2*d* are 14" drawer slides.

In an embodiment in which the lower platform 1*a* and the upper platform 1*b* are not supported by respective frames, each drawer slide 2*d* is attached to a respective side edge of the upper platform 1*b* and to upper ends of respective one or more longitudinally-extending adjustable posts 3*a*, 3*b*. In an embodiment in which supportive frames are utilized, each drawer slide 2*d* is attached to a respective side edge of the side supports 2*c*, as well as to upper ends of respective one or more longitudinally-extending adjustable posts 3*a*, 3*b*.

Lower ends of the adjustable posts 3*a*, 3*b* are attached to the lower platform 1*a* or to the first frame (if utilized) (i.e., the side supports 2*a* and the horizontal real support 2*b*). In an alternative embodiment, non-adjusting posts may instead be utilized.

In the embodiment shown in FIGS. 1 and 2, four adjustable posts 3*a*, 3*b* are utilized, each positioned substantially at a corner of the lower platform 1*a* and the upper platform 1*b* to longitudinally extend therebetween when the upper platform 1*b* is in a closed position. In another embodiment, two adjustable posts 3*a*, 3*b*, one at each side of the lower platform 1*a* and the upper platform 1*b* (e.g., in a substantially central side region), may be utilized; although, as appreciated by those of ordinary skill in the art, four adjustable posts 3*a*, 3*b* will provide extra stability to the pedal rack 100. Additional adjustable posts 3*a*, 3*b* may be incorporated for extra support.

In an embodiment, each adjustable post 3*a*, 3*b* is comprised of an inner shaft 3*b* and an outer shaft 3*a*, each with holes that align with one another. The inner shaft 3*b* is of a smaller size than the outer shaft 3*a* to allow movement of the inner shaft 3*b* within the outer shaft 3*a*. In an embodiment, as shown in FIGS. 1 and 2, lower ends of the outer shafts 3*a* are attached to the lower platform 1*a* or to the first frame (if utilized); and upper ends of the inner shaft 3*b* are attached to the drawer slides 2*d*. Insertion of a hitch pin 3*c*, or the like, in the holes of the inner shaft 3*b* and the outer shaft 3*a* secures the shafts 3*a* and 3*b* to one another at a desired height.

In an embodiment, the outer shaft 3*a* is comprised of 4½" long pieces of 1" square aluminum tubing. Nuts and bolts are used to attach the outer shaft 3*a* to the lower platform 1*a* or the first frame (i.e., two side supports 2*a* and horizontal rear support 2*b*). The inner shaft 3*b* is, in an embodiment, comprised of 6½" long pieces of ¾" square aluminum tubing. Nuts and bolts are used to attached an inside edge of the inner shaft 3*b* to the drawer slides 2*d*. Other materials, sizes, and fastening means may also be used, as appreciated by one of ordinary skill in the art.

The drawer slides 2*d* are configured to extend the movable upper platform 1*b* to an open position (FIG. 1) in which at least a portion of a top surface of the stationary lower platform 1*a* is exposed, and retract the movable upper platform 1*b* to a closed position (FIG. 2) in which the top surface of the stationary lower platform 1*a* is substantially concealed by the movable upper platform 1*b*.

In an embodiment, the pedal rack 100 may also include an upper platform foot ledge 4*a* attached to a front edge of the movable upper platform 1*b*. The foot ledge 4*a* provides a dedicated location for a user's foot to extend and retract the upper platform 1*b* without damaging the upper platform 1*b*. In an embodiment, the foot ledge 4*a* is made of one 16⅞" piece of ¾" angled aluminum, attached using nuts and bolts to the front of the upper platform 1*b*. The foot ledge 4*a* may be constructed of various other materials, may be other sizes, and may be attached with other attachment means.

Figure 3:
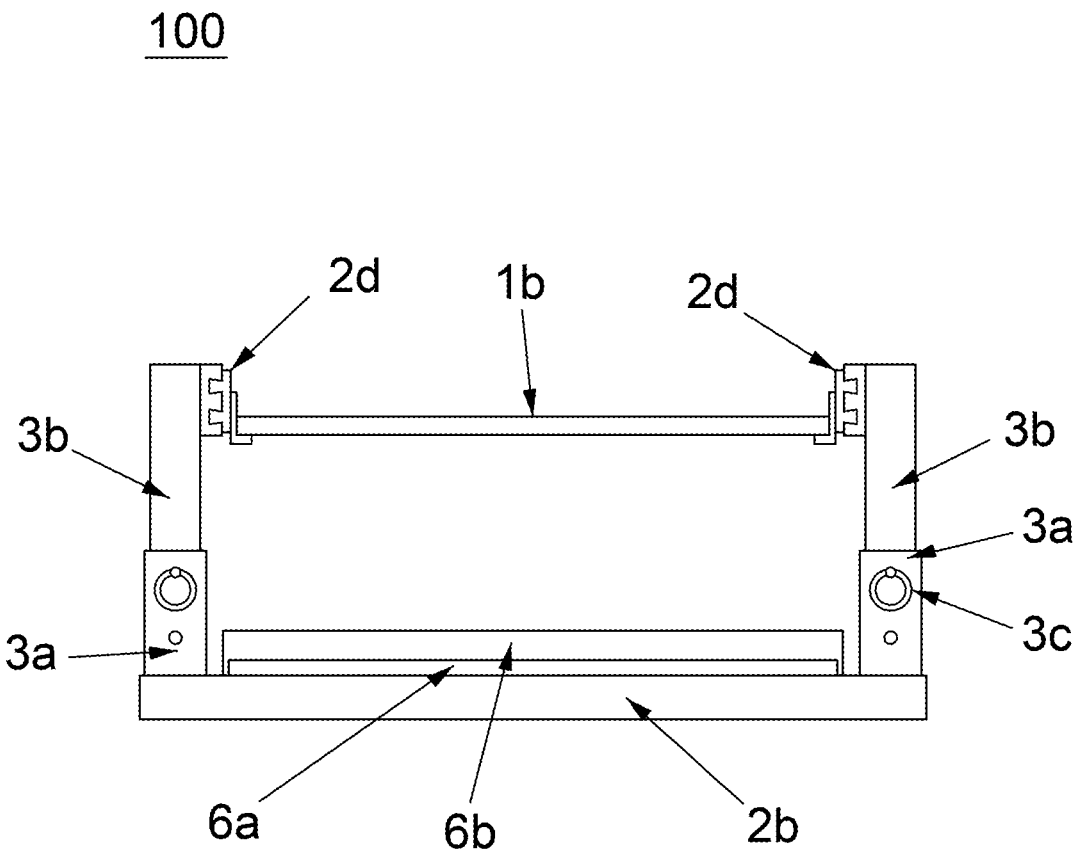
FIG. 3 is a back view of a pedal rack, according to an embodiment.

FIG. 3 is a back view of the pedal rack 100, according to an embodiment. In an embodiment as shown in FIGS. 1 and 3, the pedal rack 100 includes one or more riser supports, comprised of components 6*a*, 6*b*, 6*c*, positioned at a back portion of the stationary lower platform 1*a* and configured to angle the one or more effect pedals and/or floorboards contained on the stationary lower platform 1*a* for better access and visibility. In an embodiment, the riser support is constructed by attaching two 20"×1½"×½" pieces of wood (6*a* and 6*b*) to two hinges (6*c*) using screws. One of the two hinged pieces of wood (6*a*) is then attached using screws to a back end portion of the lower platform 1*a*. The other piece of hinged wood (6*b*) is flipped up to a 45 degree angle to provide riser support for the lower platform effect pedals and/or floorboards.

Additionally, to prevent the one or more effect pedals and/or floorboards contained on the stationary lower platform 1*a* from sliding off of the stationary lower platform 1*a*, a pedal brace 5*a* may be attached at a front portion on the top surface of the lower platform 1*a*. The lower platform pedal brace 5*a* is, according to an embodiment, constructed from one 11¼" piece of ¾" angled aluminum, attached using nuts and bolts to the front of the lower platform 1*a*.

In additional and/or alternate embodiments, riser supports and/or pedal braces may also be provided on the upper platform 1*b*.

In an embodiment, the pedal rack 100 also includes one or more handles (not shown) to aid in the transporting and positioning of the pedal rack 100 (and any effect pedals and/or floorboards contained thereon). The handles may be comprised of small lengths of chain and clear rubber tubing (e.g., 6" lengths) and may be attached to the center or near center region of each lower supporting frame side support 2*a* using nuts and bolts.

In use, a guitarist takes the following steps to use the pedal rack 100: place the pedal rack 100 on a performance area (e.g., floor, stage, etc.); adjust the riser supports on the lower platform to provide an angled view of the effect pedals and/or floorboards; place the effect pedals and/or floorboards on the lower platform; extend the upper platform (which may alternatively be done prior to adjusting the riser supports and placing the effect pedals and/or floorboards on the lower platform); place the effect pedals and/or floorboards on the upper platform (which may be done prior to doing so on the lower platform and/or prior to extending the upper platform); make all necessary cable connections among the effect pedals and/or floorboards and an amplification source; adjust the retraction amount of the upper platform to a desired position, allowing for the effect pedals and/or floorboards to be visible and the switches and program number displays accessible, as desired. Additionally, during set-up of the pedal rack 100 or as an initial step, the adjustable posts may be adjusted to a desired height.

Figure 4:
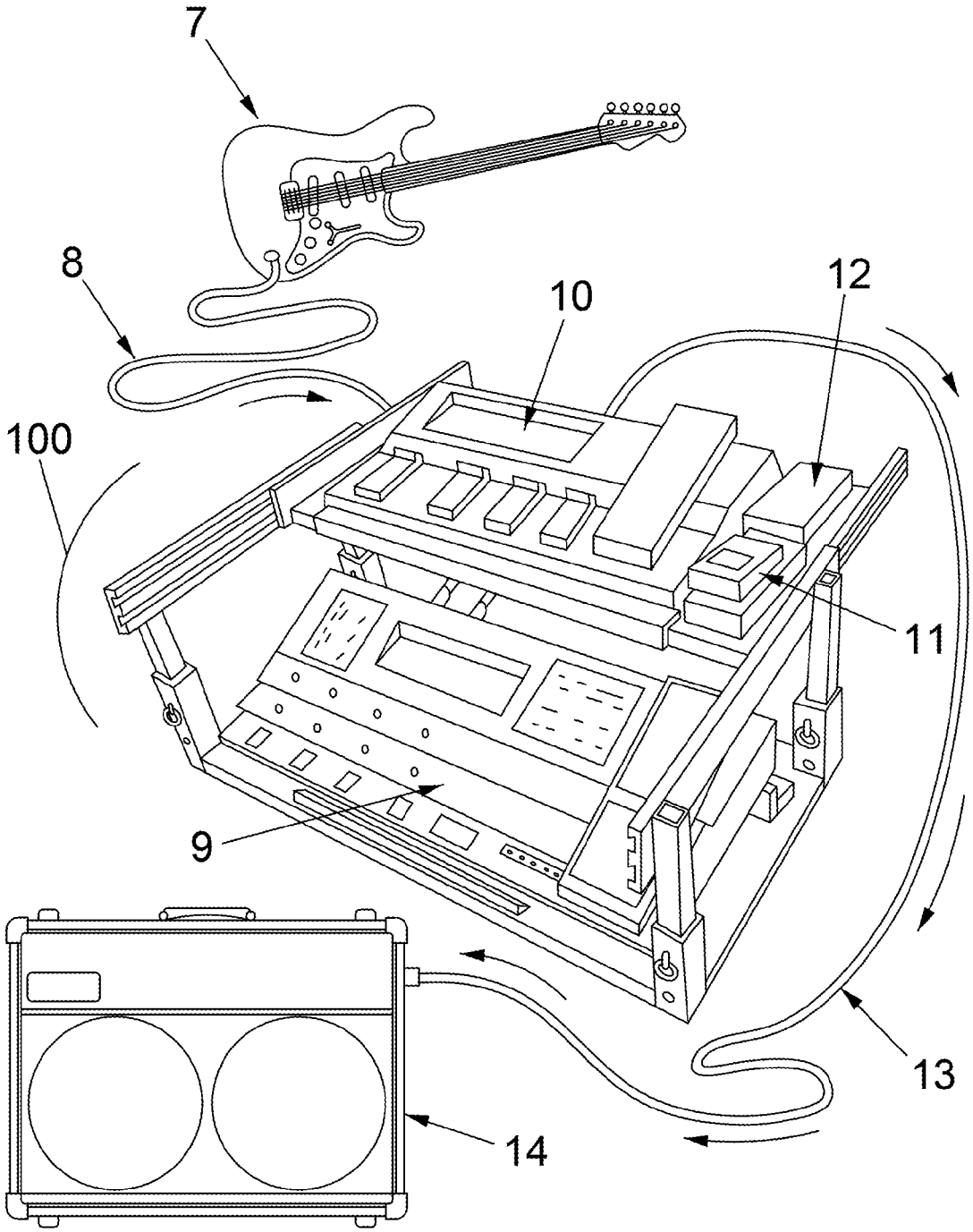
FIG. 4 is a perspective view of a pedal rack in use, according to an embodiment.

FIG. 4 is a perspective view of a pedal rack in use, according to an embodiment. A lower floorboard 9 is positioned on the lower platform 1*a*; and an upper floorboard 10, an upper front effect pedal 11, and an upper rear effect pedal 12 are placed on the upper platform 1*b*. A guitar 7 is connected to the pedal rack 100 via a cable 8. A connection between the pedal rack to an amplifier 14 is achieved through a cable 13. This configuration is just one example of how the pedal rack 100 can be used. Other configurations of effect pedals and/or floorboards may be used, as desired by a guitarist.

The pedal rack described herein provides easier access to effect pedals and/or floorboards used by guitarists on stage during practices and/or performances than is currently provided by arranging the effect pedals and/or floorboards on stage. The pedal rack conveniently saves space on stage and provides a streamlined packing and storage solution for the effect pedals and/or floorboards (the entire pedal rack with the effect pedals and/or floorboards can be moved and stored as a single unit). By simply pushing or pulling with one's foot, access to effect pedals and/or floorboards on two platforms is achieved. Additionally, the components comprising the pedal rack are commonly available and adaptable.

It will be appreciated that the above figures and description provide exemplary, non-limiting configurations. Although the present invention has been described with reference to these exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

I claim:

1. An adjustable, floor-mounted electric guitar effect performance and storage apparatus, comprising:

a stationary lower platform;

a movable upper platform;

a plurality of drawer slides, each attached to a respective side edge of the movable upper platform and to upper ends of respective one or more longitudinally-extending adjustable posts;

wherein lower ends of the adjustable posts are attached to the stationary lower platform;

wherein the plurality of drawer slides are configured to extend the movable upper platform to an open position in which at least a portion of a top surface of the stationary lower platform is exposed, and retract the movable upper platform to a closed position in which the top surface of the stationary lower platform is substantially concealed by the movable upper platform;

wherein the stationary lower platform and the movable upper platform are substantially planar, are substantially parallel with respect to one another when the movable upper platform is in the closed position, and are substantially parallel to a surface on which the apparatus rests; and wherein each of the stationary lower platform and the movable upper platform are configured to hold one or more effect pedals and floorboards.

2. The apparatus of claim 1, further comprising:

an upper platform foot ledge attached to a front edge of the movable upper platform.

3. The apparatus of claim 1, further comprising:

one or more riser supports positioned at a back portion of the stationary lower platform configured to angle the one or more effect pedals and floorboards contained on the stationary lower platform.

4. The apparatus of claim 3, further comprising:

a lower platform pedal brace attached at a front portion of the stationary lower platform configured to prevent the one or more effect pedals and floorboards contained on the stationary lower platform from sliding off of the stationary lower platform.

5. The apparatus of claim 1, wherein the stationary lower platform is supported by a first frame and wherein the movable upper platform is supported by a second frame;

wherein the plurality of drawer slides are each attached to a respective side portion of the second frame and to the upper ends of the respective one or more longitudinally-extending adjustable posts; and wherein the lower ends of the adjustable posts are attached to the first frame.

6. The apparatus of claim 1, wherein the adjustable posts comprise four adjustable posts, each positioned substantially at a corner of the stationary lower platform and the movable upper platform to longitudinally extend between the stationary lower platform and the movable upper platform when the movable upper platform is in the closed position.

7. The apparatus of claim 6, wherein the adjustable posts are each comprised of an outer shaft and an inner shaft with holes that align with one another, the inner shaft of a smaller size than the outer shaft to allow movement of the inner shaft within the outer shaft;

wherein, in each of the adjustable posts, insertion of a hitch pin in the holes secures the inner and outer shafts to one another.

8. An adjustable, floor-mounted electric guitar effect performance and storage apparatus, comprising:

a stationary lower platform supported by a first frame;

a movable upper platform supported by a second frame;

a plurality of drawer slides, each attached to a respective side edge of the second frame and to upper ends of respective one or more longitudinally-extending adjustable posts;

wherein lower ends of the adjustable posts are attached to the first frame;

wherein the plurality of drawer slides are configured to extend the movable upper platform to an open position in which at least a portion of a top surface of the stationary lower platform is exposed, and retract the movable upper platform to a closed position in which the top surface of the stationary lower platform is substantially concealed by the movable upper platform;

wherein the stationary lower platform and the movable upper platform are substantially planar, are substantially parallel with respect to one another when the movable upper platform is in the closed position, and are substantially parallel to a surface on which the apparatus rests; and wherein each of the stationary lower platform and the movable upper platform are configured to hold one or more effect pedals and floorboards.

9. The apparatus of claim 8, further comprising:

an upper platform foot ledge attached to a front edge of the movable upper platform.

10. The apparatus of claim 8, further comprising:

one or more riser supports positioned at a back portion of the stationary lower platform configured to angle the one or more effect pedals and floorboards contained on the stationary lower platform.

11. The apparatus of claim 10, further comprising:

a lower platform pedal brace attached at a front portion of the stationary lower platform configured to prevent the one or more effect pedals and floorboards contained on the stationary lower platform from sliding off of the stationary lower platform.

12. The apparatus of claim 8, wherein the adjustable posts comprise four adjustable posts, each positioned substantially at a corner of the stationary lower platform and the movable upper platform to longitudinally extend between the stationary lower platform and the movable upper platform when the movable upper platform is in the closed position.

13. The apparatus of claim 12, wherein the adjustable posts are each comprised of an outer shaft and an inner shaft with holes that align with one another, the inner shaft of a smaller size than the outer shaft to allow movement of the inner shaft within the outer shaft;

wherein, in each of the adjustable posts, insertion of a hitch pin in the holes secures the inner and outer shafts to one another.

14. A floor-mounted electric guitar effect performance and storage apparatus, comprising:

a stationary lower platform;

a movable upper platform;

a plurality of drawer slides, each attached to a respective side edge of the movable upper platform and to upper ends of respective one or more longitudinally-extending posts;

wherein lower ends of the posts are attached to the stationary lower platform;

wherein the plurality of drawer slides are configured to extend the movable upper platform to an open position in which at least a portion of a top surface of the stationary lower platform is exposed, and retract the movable upper platform to a closed position in which the top surface of the stationary lower platform is substantially concealed by the movable upper platform;

wherein the stationary lower platform and the movable upper platform are substantially planar, are substantially parallel with respect to one another when the movable upper platform is in the closed position, and are substantially parallel to a surface on which the apparatus rests; and wherein each of the stationary lower platform and the movable upper platform are configured to hold one or more effect pedals and floorboards.

* * * * *